US005839414A

United States Patent [19]

Klinger et al.

[11] Patent Number: 5,839,414

[45] Date of Patent: Nov. 24, 1998

[54] FUEL INJECTION SYSTEM FOR INTERNAL COMBUSTION ENGINES

[75] Inventors: Horst Klinger, Ludwigsburg; Uwe Kuhn, Riederich; Bernd Rosenau, Tamm; Peter Traub, Stuttgart; Thomas Goettel, Schwaikheim; Gerd Loesch, Stuttgart; Sandro Soccol, Bietigheim-Bissingen, all of Germany; Regis Blanc, Lyons, France; Andre Fromentoux, St. Pierre de Chandieu, France; Francois Rossignol, Mornant, France

[73] Assignee: Robert Bosch GmbH, Stuttgart, Germany

[21] Appl. No.: 860,588

[22] PCT Filed: Aug. 9, 1996

[86] PCT No.: PCT/DE96/01497

§ 371 Date: Jul. 25, 1997

§ 102(e) Date: Jul. 25, 1997

[87] PCT Pub. No.: WO97/17538

PCT Pub. Date: May 15, 1997

[30] Foreign Application Priority Data

Nov. 8, 1995 [DE] Germany ..... 195 41 507.8

[51] Int. Cl.[6] ..... F02M 37/04

[52] U.S. Cl. ..... 123/467; 137/512; 123/510; 417/454

[58] Field of Search ..... 123/495, 467, 123/510, 506, 456; 137/512; 417/454

[56] References Cited

U.S. PATENT DOCUMENTS

| | | | |
|---|---|---|---|
| 3,726,612 | 4/1973 | Greene | 417/454 |
| 4,026,322 | 5/1977 | Thomas | 137/512 |
| 4,277,229 | 7/1981 | Pacht | 417/454 |
| 4,340,084 | 7/1982 | Snow | 137/512 |
| 4,396,151 | 8/1983 | Kato | 123/510 |
| 4,729,401 | 3/1988 | Raines | 137/512 |
| 5,015,160 | 5/1991 | Hlousek | 123/467 |
| 5,176,175 | 1/1993 | Farnham | 137/614.18 |
| 5,584,314 | 12/1996 | Bron | 137/512 |
| 5,605,449 | 2/1997 | Reed | 137/512 |
| 5,636,975 | 6/1997 | Tiffany | 417/454 |

*Primary Examiner*—Carl S. Miller
*Attorney, Agent, or Firm*—Edwin E. Greigg; Ronald E. Greigg

[57] ABSTRACT

A fuel injection system for internal combustion engines, having a high-pressure pump, whose pump work chamber can be made to communicate on the intake side with a fuel tank via a supply line and on the compression side with a common rail via a high-pressure line, from which common rail a plurality of injection lines lead away to the individual injection valves, and having one pressure valve each in the supply line and the high-pressure line, by way of which a return flow of fuel out of the pump work chamber into the supply line and out of the high-pressure line into the pump work chamber is prevented. The pressure valve of the supply line and the pressure valve of the high-pressure line are disposed in a common valve combination.

12 Claims, 1 Drawing Sheet

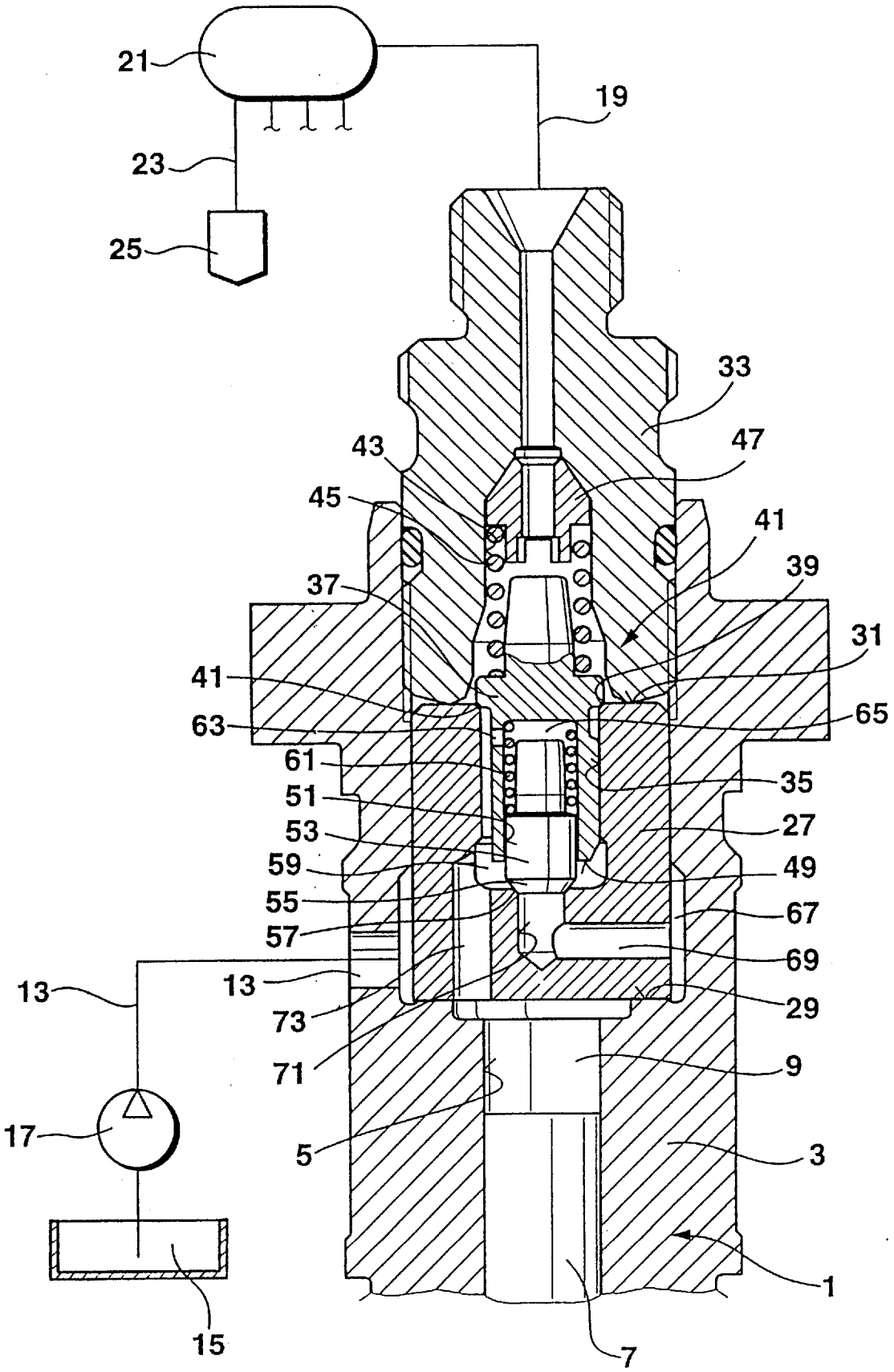
21
19
23
25
33
43
47
45
41
39
37
31
41
65
63
61
35
51
27
53
59
49
55
67
57
69
13
13
29
73
71
9
17
5
3
1
15
7

FUEL INJECTION SYSTEM FOR INTERNAL COMBUSTION ENGINES

BACKGROUND OF THE INVENTION

The invention is directed to improvement in fuel injection system for internal combustion engines. In one such fuel injection system, known from European Patent Application EP 0 531 533 A1, a high-pressure pump pumps fuel out of a low-pressure reservoir into a high-pressure collection chamber (common rail), from which a plurality of injection lines lead away to the individual injection valves protruding into the engine combustion chamber. In the known injection system, the low-pressure reservoir is embodied by a fuel tank, from which fuel is pumped by a feed pump at a low pilot pressure via a supply line into the pump work chamber of the high-pressure pump, which is embodied as a piston pump.

In order particularly during the high-pressure pumping to prevent a return flow of fuel from the pump work chamber of the high-pressure pump into the low-pressure reservoir and to meter the high-pressure supply quantity, a pressure valve, which in the known fuel injection system is actuated by means of a magnet valve, is inserted into the supply line. In the fuel injection system of the same generic type known from British Patent GB 2 263 317, however, it is also known for this pressure valve in the supply line to be embodied as a simple check valve. Another pressure valve, preferably a check valve, is inserted in the known fuel injection systems into the high-pressure line between the pump work chamber of the high-pressure pump and the common rail. This is intended to prevent a return flow of fuel, which is at high pressure, out of the collection chamber to the high-pressure pump during the intervals between fuel supply periods.

The known injection systems have the disadvantage, however, that the individual pressure valves are inserted separately into the high-pressure line and the supply line, which entails considerable engineering and assembly effort and expense.

OBJECTS AND SUMMARY OF THE INVENTION

It is a principal object of the fuel injection system of the present invention, and an advantage over the prior art that the pressure valves of the supply line and the high-pressure line are integrated into a single, common valve combination. This common valve combination is moreover advantageously inserted into the housing of the high-pressure pump, so that a compact and very favorable structural form in terms of strength can be attained. Moreover, separately installing the pressure valves in the individual lines is now unnecessary, which considerably lowers the expense for assembly.

Another object of the invention is provided by guiding the individual valve members inside one another, so that the requisite installation space can be reduced yet again, and the valve combination can be inserted in a structurally simple way into the pump housing in the axial direction of the pump piston. Part of the valve combination forms the boundary of the pump work chamber on the side remote from the pump piston, and another part at the same time forms the connection stub, which is required anyway, for connecting the high-pressure pump to the high-pressure line. Still another object of the invention is attained by the axial in-line disposition of the individual pressure valves in the valve combination, which allows the greatest possible wall thickness in the region of the pressure chambers, while the external dimensions remain the same.

The invention will be better understood and further objects and advantages thereof will become more apparent from the ensuing detailed description of preferred embodiments taken in conjunction with the drawings.

BRIEF DESCRIPTION OF THE DRAWING

A single exemplary embodiment of the fuel injection system according to the invention for internal combustion engines is shown in the drawing and will be described in detail below.

The drawing figure shows a section through part of the high-pressure pump and the valve combination and a schematic representation of the connecting lines.

DESCRIPTION OF THE EXEMPLARY EMBODIMENT

The fuel injection system for internal combustion engines shown in the figure has a high-pressure pump 1, in which housing 3 a cylinder bore 5 is provided, and in which a pump piston 7 is driven to reciprocate axially by a cam drive, not otherwise shown. With its end face remote from the cam drive, the pump piston 7 defines a pump work chamber 9 in the cylinder bore 5; this chamber is bounded on the side remote from the pump piston by a valve combination 11 inserted into a widened portion of the cylinder bore 5. The pump work chamber 9 can be made to communicate via the valve combination 11 with a supply line 13, which begins at a fuel tank 15 and into which a feed pump 17 is inserted, through which the fuel is pumped out of the fuel tank 15 via the supply line 13 and the valve combination 11 is supplied at a low pilot pressure into the pump work chamber 9 of the high-pressure pump 1. Also connected to the valve combination 11 is a high-pressure line 19, by way of which the pump work chamber 9 can be made to communicate with a common rail 21, from which a plurality of injection lines 23 lead away to the individual injection valves 25 protruding into the combustion chamber of the engine.

To avoid an unintended return flow of fuel out of the pump work chamber 9 into the supply line 13 and from the high-pressure line 19 into the pump work chamber 9, one pressure valve each is inserted into the high-pressure line 19 and the supply line 13, which are accommodated in the common valve combination 11 inserted into the pump housing 3.

To that end, the valve combination 11 has first a valve body 27, which is inserted into the pump housing 3 in such a way that with one face end it comes into contact with a bore shoulder 29 of the pump housing 3, formed between the cylinder bore 5 and its portion of widened diameter. On its end face 31 remote from the bore shoulder 29, the valve body 27 is acted upon by a common stub 33, which is screwed into the bore of the pump housing 3 and axially braces the valve body 27 against the bore shoulder 29, and the high-pressure line 19 is connected to the end of the stub that protrudes out of the pump housing 3.

The valve body 27 has a guide bore 35, originating at its end face 31, in which bore a first valve member 37 is axially guided. The cylindrical first valve member 37, which has flattened faces on its circumference, has a conical sealing face 39, which is disposed on an annular collar and with which it cooperates with a first conical valve seat 41 on the valve body 27, this seat being formed at the outlet of the guide bore 35 at the end face 31. The first valve member 37 protrudes, with its end protruding out of the valve body 27, into a through bore 43 in the connection stub 33; this bore adjoins the first valve seat 41, and a first valve spring 45 is disposed in it; this spring is fastened between the first valve member 37 and a support part 47 supported on a bore shoulder and having a through opening, and it keeps the first valve member 37 pressed into contact with the first valve seat 41.

Also provided in the first valve member 37 is a blind bore 51, originating at its lower end face 49 remote from the connection stub 33, in which bore a second valve member 53 is axially guided. This second valve member 53, on its end protruding out of the blind bore 51, has a conical or spherical sealing face 55, formed by a cross-sectional constriction, with which it cooperates with a second valve seat 57 on the valve body 27. The second valve seat 57 adjoins a widened-diameter pressure chamber 59 in the valve body 27 that extends along the first valve member 37 in the guide bore 35 as far as the first valve seat 41.

Between the closed end of the blind bore 51 and the second valve member 53 guided in it, a second valve spring 61 is fastened, which keeps the second valve member 53 pressed against the second valve seat 57. A transverse bore 63 is also provided in the wall of the first valve member 37, connecting the pressure chamber 59 with the restoring chamber 65 that receives the second valve spring 61. Between the valve body 27 and the wall of the pump housing 3 there is an annular chamber 67, which communicates with the supply line 13 and, via a bore 69 in the valve body 27, with a blind chamber 71 that extends along the second valve member 53 as far as the end of the second valve seat 57 remote from the pressure chamber 59.

A further connecting bore 73, beginning at the pump work chamber 9 of the high-pressure pump 1, discharges into the pressure chamber 59 of the valve combination 11.

The fuel injection system according to the invention functions as follows.

While the pump work chamber 9 of the high-pressure pump 1 is being filled, the fuel, which is at pilot feed pressure, flows out of the fuel tank 15 via the supply line 13 and the annular chamber 67, initially into the blind chamber 71. With a simultaneous intake stroke motion of the pump piston 7 in the direction of bottom dead center, a pressure difference arises between the blind chamber 71 and the pressure chamber 59, so that the second valve member 53 is lifted from the second valve seat 57, counter to the restoring force of the second valve spring 61, and the fuel can flow out of the blind chamber 71 via the opening cross section at the second valve seat 57 into the pressure chamber 59 and on, via the connecting bore 73, into the pump work chamber 9.

The connection of the pressure chamber 59 with the high-pressure line 19 is closed by the first valve member 37, and the force of the first valve spring 45 is greater than the designed compressive force of the inflowing fuel. Moreover, the pressure in the high-pressure line 19 acts in the closing direction on the first valve member 37.

During the supply stroke of the pump piston 7, which follows the traversal of bottom dead center, the pressure in the pump work chamber 9 rises; when a pressure equilibrium between the blind chamber 71 and the pressure chamber 59 is reached, the second valve spring 61 pushes the second valve member 53 back into contact with the second valve seat 57, so that the connection between the supply line 13 and the pump work chamber 9 is closed. If as the supply stroke of the pump piston 7 continues the opening force at the first valve member 37, which is determined by the pressure in the common rail 21 and the force of the first valve spring 45, is exceeded, then this valve member lifts away from the first valve seat 41, so that the fuel at high pressure can flow out of the pump work chamber 9, via the connecting bore 73, the pressure chamber 59, the opening cross section at the first valve seat 41 and the through bore 43 in the connection stub 33, into the high-pressure line 19 to the common rail 21. In this process, the second valve member 53 is pushed against the second valve seat 57 not only by the force of the second valve spring 61 but also by fuel at high pressure that is flowing into the restoring chamber 65 via the transverse bore 63, but despite the axial opening stroke motion of the first valve member 37, the second valve member 53 remains securely in contact with the second valve seat 57, thus preventing a return flow of fuel into the supply line 13.

Once the supply pressure in the pump work chamber 9 drops, the first valve member 37 returns to its valve seat 41 and again closes the high-pressure line 19 relative to the pump work chamber 9 of the high-pressure pump 1.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection system for internal combustion engines, comprising, a high-pressure pump (1), having a pump work chamber (9) arranged to communicate on an intake side with a fuel tank (15) via a supply line (13) and on a compression side with a common fuel rail (21) via a high-pressure line (19), said common fuel rail feeds a plurality of injection lines (23) that leads to individual injection valves (25), and said pump further having one pressure valve each in the supply line (13) and the high-pressure line (19), said valves acting to prevent a return flow of fuel out of the pump work chamber (9) into the supply line (13) and out of the high-pressure line (19) into the pump work chamber (9) and the pressure valves of the supply line (13) and the high-pressure line (19) are disposed in a common valve combination (11) with one pressure valve guiding the other pressure valve.

2. The fuel injection system of claim 1, in which the valve combination (11) is inserted into the housing (3) of the high-pressure pump (1).

3. The fuel injection system of claim 1, in which the pressure valves of the supply line (13) and the high-pressure line (19) are disposed axially in line with one another.

4. The fuel injection system of claim 3, in which the high-pressure pump (1) comprises a piston pump with a pump piston (7) driven to reciprocate, and in which the valve combination (11) adjoins the pump work chamber (9) in the axial direction of the pump piston (7).

5. The fuel injection system of claim 1, in which the valve combination (11) comprises a valve body (27) inserted into a bore of the pump housing (3), a connection stub (33) of the high-pressure line (19) bracing said valve body axially against a stop (29), a first valve member (37) axially guided in a guide bore (35) of the valve body (27), said first valve member having a sealing face (39) adapted to cooperate with a first valve seat (41) provided on the valve body (27), and a second valve member (53) guided axially in a blind bore (51) of the first valve member (37) and provided with a sealing face (55), said sealing face cooperating with a second valve seat (57) on the valve body (27).

6. The fuel injection system of claim 5, in which the first valve member (37) protrudes by one end into a through-bore (43) adjoining the first valve seat (41) of the connection stub (33), in which through-bore a first valve spring (45) is disposed between the first valve member (37) and a bore shoulder of the through-bore (43), and said first valve spring presses the first valve member (37) into contact with the first valve seat (41).

7. The fuel injection system of claim 6, in which a second valve spring (61), which presses the second valve member (53) against the second valve seat (57), is disposed between an end of the second valve member (53) protruding into the blind bore (51) in the first valve member (37) and an end wall of the blind bore (51).

8. The fuel injection system of claim 7, in which an annular chamber (67) is defined between the valve body (27) and the wall of the pump housing (3), into which chamber the supply line (13) discharges and which chamber communicates via a bore (69) with a blind chamber (71) in the valve body (27) that extends as far as the second valve seat (65).

9. The fuel injection system of claim 8, in which the end of the second valve seat (57) remote from the blind chamber (71) is adjoined by a pressure chamber (59), which communicates continuously with the pump work chamber (9) via a connecting bore (73), which bore extends along the first valve member (37) as far as the first valve seat (41).

10. The fuel injection system of claim 9, in which a transverse bore (63) is provided in the first valve member (37) which bore begins at the pressure chamber (59) and discharges adjacent the end wall of the blind bore (51).

11. The fuel injection system of claim 5, in which the first and second valve seats (41, 57) on the valve body (27) and the sealing faces (39, 55) cooperating with said valve seats are formed conically on the first and second valve members (37, 53).

12. The fuel injection system of claim 1, in which the pressure valves of the high-pressure line (19) and supply line (13) comprise check valves.

* * * * *